US009657610B2

(12) United States Patent
Radinger et al.

(10) Patent No.: US 9,657,610 B2
(45) Date of Patent: May 23, 2017

(54) HYDRAULIC CAMSHAFT ADJUSTING DEVICE WITH SPHERICAL SECTION-LIKE LOCK

(71) Applicant: Schaeffler Technologies AG & Co. KG, Herzogenaurach (DE)

(72) Inventors: Norbert Radinger, Nuremberg (DE); Olaf Boese, Nuremberg (DE); Sebastian Krueger, Fuerth (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/768,746

(22) PCT Filed: Jan. 17, 2014

(86) PCT No.: PCT/DE2014/200004

§ 371 (c)(1),
(2) Date: Aug. 18, 2015

(87) PCT Pub. No.: WO2014/135158

PCT Pub. Date: Sep. 12, 2014

(65) Prior Publication Data

US 2015/0377085 A1 Dec. 31, 2015

(30) Foreign Application Priority Data

Mar. 8, 2013 (DE) ..... 10 2013 203 955

(51) Int. Cl.
*F01L 1/34* (2006.01)
*F01L 1/344* (2006.01)

(52) U.S. Cl.
CPC ... *F01L 1/3442* (2013.01); *F01L 2001/34453* (2013.01); *F01L 2001/34466* (2013.01); *F01L 2001/34473* (2013.01)

(58) Field of Classification Search
CPC ..... F01L 1/3442; F01L 2001/34453; F01L 2001/34466; F01L 2001/34473
USPC ..... 123/90.15, 90.17
See application file for complete search history.

(56) References Cited

U.S. PATENT DOCUMENTS 2,775,959 A * 1/1957 Geer ..... F01L 1/32 123/90.3
6,289,862 B1 9/2001 Schaefer et al.
8,820,278 B2 * 9/2014 Kobayashi ..... F01L 1/3442 123/90.15

(Continued)

FOREIGN PATENT DOCUMENTS

DE 10332881 7/1958
DE 19808619 9/1999
DE 19961567 7/2001

(Continued)

*Primary Examiner* — Ching Chang
(74) *Attorney, Agent, or Firm* — Davidson, Davidson & Kappel, LLC

(57) ABSTRACT

A hydraulic camshaft adjustment device (1) of the vane type, with a stator (2) and a rotor (3) arranged concentrically and rotatably inside the stator is provided. A locking device (6) for preventing a rotation between the rotor (3) and the stator (2) is arranged between these two components (2, 3) such that a locking element (7) of the locking device (6) creates an interlocking fit that blocks the rotation, the locking element (7) being designed in the nature of a plate.

18 Claims, 9 Drawing Sheets

(56) References Cited

U.S. PATENT DOCUMENTS

| | | | |
|---|---|---|---|
| 2002/0023602 | A1 | 2/2002 | Komazawa et al. |
| 2011/0174252 | A1 | 7/2011 | Tada |

FOREIGN PATENT DOCUMENTS

| | | |
|---|---|---|
| DE | 102011009023 | 7/2011 |
| EP | 1065348 | 1/2001 |
| EP | 2472074 | 7/2012 |
| JP | 2003049616 | 2/2003 |
| JP | 2004257356 | 9/2004 |

* cited by examiner

HYDRAULIC CAMSHAFT ADJUSTING DEVICE WITH SPHERICAL SECTION-LIKE LOCK

The present invention relates to a vane-type hydraulic camshaft adjusting device, including a stator and a rotor which is concentrically and rotatably situated therein, a locking device being situated axially between the rotor and the stator for the purpose of preventing a rotation between the rotor and the stator or a stator-fixed component, so that a locking element of the locking device produces a form-locked fit which blocks the rotation of the rotor relative to the stator. Vane-type hydraulic camshaft adjusting devices including locking devices which use bolt-like or pin-like locking elements are sufficiently well known.

BACKGROUND

The rotor is normally secured against a relative rotation with respect to the stator, either in a position in which one vane of the rotor is in contact with the stator or is secured in a center-locking position, i.e., in a position in which the vane is situated between its extreme positions.

Due to their special functionality, locking bolts or locking pins unfortunately have very large dimensions in the axial direction and take up a relatively large amount of the axial installation space of the entire camshaft adjuster. However, this installation space is limited. And yet the bolts require a minimum amount of locking depth to establish a secure lock. The axial length of the camshaft adjuster/camshaft adjusting device is also not conducive thereto. Under load, the system also experiences high forces, which necessitates complex counter-measures. Moreover, the manufacture of the individual parts is unfortunately relatively expensive.

SUMMARY OF THE INVENTION

It is an object of the present invention to implement a lock which is cost-optimized in its manufacture, preferably requires few components and yet is able to transmit high forces. A reduction of the axial installation space of the camshaft adjuster/camshaft adjusting device is also to be facilitated. In particular, it should be possible to achieve a center-locking mechanism, which preferably makes do without rotor limit stops.

The present invention provides that in a generic hydraulic camshaft adjuster or a generic hydraulic camshaft adjusting device, wherein the locking element is designed in the manner of a plate.

The rotor is locked against rotation relative to the stator, as needed, using the plate-shaped/plate-like locking element. If multiple locking elements are used together in a logical interconnection, the rotor may, as needed, be locked against rotation centrally relative to the stator. A particularly space-saving design of the locking element is implemented.

It is thus advantageous if the locking element designed as a plate has two sides/side surfaces (which are essentially planar, preferably running parallel to each other), which are connected to each other via an outer contour, the outer contour of the locking element being provided with a concave, convex/crowned, smooth or fluted design, for example by designing the locking element as an ellipsoidal section or as a spherical section. If the locking element is designed as an ellipsoidal section or as a spherical section, a spherical section, in particular, is selected, with the aid of which a uniform, low-friction and fault-free swing-out of the locking element is achieved from a bracket in which it is accommodated. The formation of a seal is also made easier thereby. For example, the outer contour of the spherical section of the locking element has a crowned/convex design. The convex outer contour is characterized as a rounded shape in two dimensions positioned vertically to each other.

In the event that no locking is desired to facilitate a frictionless relative rotation between the stator and the rotor, it is advantageous to insert the locking element into a blind hole by interposing a spring element, the blind hole being provided on a front side of the rotor or on a front side of a stator-fixed component facing the rotor, such as a cover fastened to the stator.

In particular, it is advantageous if the blind hole accommodating the spring element is introduced into the rotor or into a receiving bushing, which is separate from the rotor and is connected to the rotor in the operating state. Of these two variants, however, the insertion of the locking element into a blind hole introduced into the rotor is clearly advantageous, the blind hole being able to be designed as a bore. Of course, it is also possible to design the blind hole as a through-hole, also as a bore, although in this case attention must be paid to the oil lines inside the rotor to ensure that they are not damaged.

To enable the spring element to be securely accommodated, it is advantageous if the blind hole has a spring element receiving section, such as an indentation, in its base, in which the spring element is at least partially supported. The blind hole preferably has a cuboid indentation on its base, into which a spring element, which is designed separately from the rotor, is at least partially inserted. Of course, a cube-shaped indentation may also be selected, in principle, however, the rectangular shape of the base surface of the indentation being advantageous, since it is particularly easy to introduce and ensures a great deal of design flexibility.

One advantageous exemplary embodiment is also characterized in that the locking element engages with a recess on the stator-fixed component, such as the cover, in a rotation-inhibiting manner, or it engages with a recess on the front side of the rotor in a rotation-inhibiting manner. Once again, the first of the two variants is particularly advantageous. One refinement is also characterized in that the recess has a U-shaped or horseshoe-shaped outer contour (the legs being connected to each other), and/or a recess base extends to the surface of the stator-fixed component or the front side of the rotor in an inclined or angled manner. A good form-locked fit may be achieved, due to the inclination or the angle.

It is furthermore advantageous if at least two locking elements are present for the purpose of implementing a center-locking mechanism. The increased requirements of modern internal combustion engines may be met thereby.

If the locking elements and the particular spring element are each situated in a hole provided for both components in such a way that the particular spring element axially moves or pivots at least one part of the locking element assigned thereto in such a way that a rotation of the rotor may be prevented in any direction, it is possible to dispense with the stop of a vane against the stator.

It is also advantageous if a locking device is present on each front side of the rotor, and/or if two or more locking devices are present on the same side or opposite sides of the rotor. This results in a particularly efficient utilization of the axial installation space. Maintenance and assembly may also be further facilitated.

The costs may be reduced if the spring element is preferably designed as a bent sheet metal strip, a helical compression spring or a rubber, composition rubber or elastomer element.

The structural arrangement of a spherical section for preventing the rotation of the rotor relative to the stator is thus a novel method and results in an improved hydraulic camshaft adjusting device. The rotor of the camshaft adjuster is mounted in the stator and is axially closed by two disks or covers. An indentation, into which the spherical section-like locking element is placed, together with a spring element, is situated on the front side of the rotor itself. The indentation is dimensionally designed in such a way that, during the assembly of the disk/cover, the spherical section dips all the way into the indentation and is terminated flush against a planar surface or the rotor or the disk/cover. The spring element is thereby tensioned in this position.

A ramp-shaped indentation having a one-sided stop surface is situated at a defined position in the disk. If the rotor is now rotated relative to the stator and to the disks fastened thereto, the spherical section also moves relative to the disks and the stator. When the spherical section reaches the indentation, the spring element relaxes according to the ramp in the indentation. The spherical section thus engages with the indentation and thereby prevents the rotor from continuing to rotate. If the rotor is now moved counter to the preceding rotation direction, the spherical section follows the ramp and pretensions the spring element again. This unlocks the rotor again. The rotor may also be unlocked again hydraulically (with the aid of oil pressure/oil).

One or multiple limit stops for the rotor are integrated into the stator, which limit the ability of both components to rotate. If the rotor is now placed against a limit stop, the rotor may be completely locked in with the aid of the spherical section. A rotation is then no longer possible.

To be able to unlock the complete system again, oil pressure must be applied to the spherical section from the cover side to press the spherical section back into the indentation. The rotor is freed thereby and is able to rotate.

If a center-locking mechanism is implemented with the aid of two or more locking elements, a slight variation must be undertaken. Since the spherical section is normally able to block the rotation in only one direction, and operation must be possible in the center position without other limit stops, it is absolutely necessary to use at least two spherical sections simultaneously, situated in opposite directions. Since each spherical section may thus capture one rotation direction, this is an appropriate option.

Once both spherical sections are engaged, the rotor is trapped in both rotation directions and its position is fixed. To be able to unlock the complete system again, oil pressure must be applied to the spherical sections from the cover side on the one front side and/or the other front side to press the spherical sections back into the particular indentation. The rotor is freed thereby and is able to rotate.

The two spherical sections may be mounted either on the same vane on one side, on different vanes opposite the same vane or opposite each other. They may also be mounted on the same side of the bearing diameter of the rotor or opposite each other.

For the function, it is advantageous if the spherical sections are on the same semicircle, since different circumferential forces will otherwise take effect.

In principle, the locking element may be situated outside or inside the bearing diameter.

BRIEF DESCRIPTION OF THE DRAWINGS

The present invention is also explained in greater detail with the aid of a drawing in which different exemplary embodiments are illustrated.

DETAILED DESCRIPTION

Figure 1:
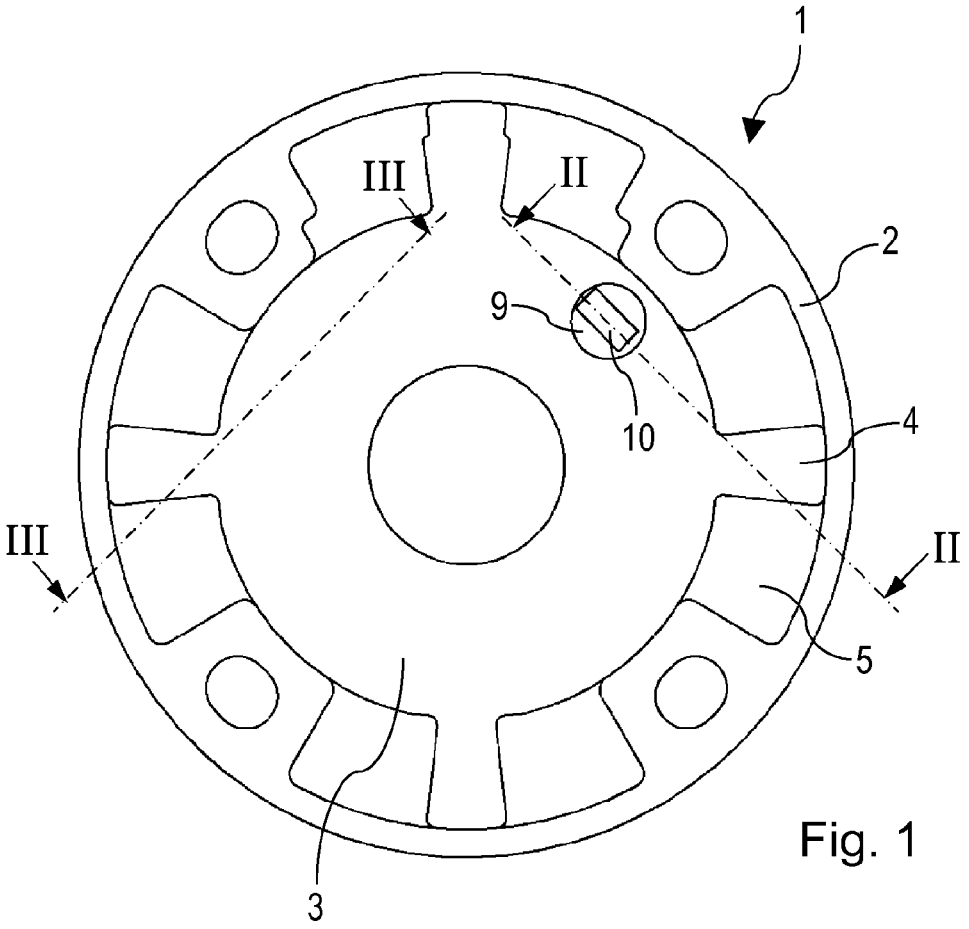
FIG. 1 shops a top view of several parts of a hydraulic camshaft adjusting device according to the present invention, among other things, a view of the rotor installed in a stator.

The figures are only of a schematic nature and are used only for the sake of understanding the present invention. Identical elements are provided with identical reference numerals.

Several components of a first specific embodiment of a hydraulic camshaft adjusting device 1 are illustrated in FIG. 1. Camshaft adjusting device 1 is of the vane type and includes a stator 2, within which a rotor 3 is provided, which has radially protruding vanes 4, which engage with vane cells 5 formed between stator 2 and rotor 3.

Figure 4:
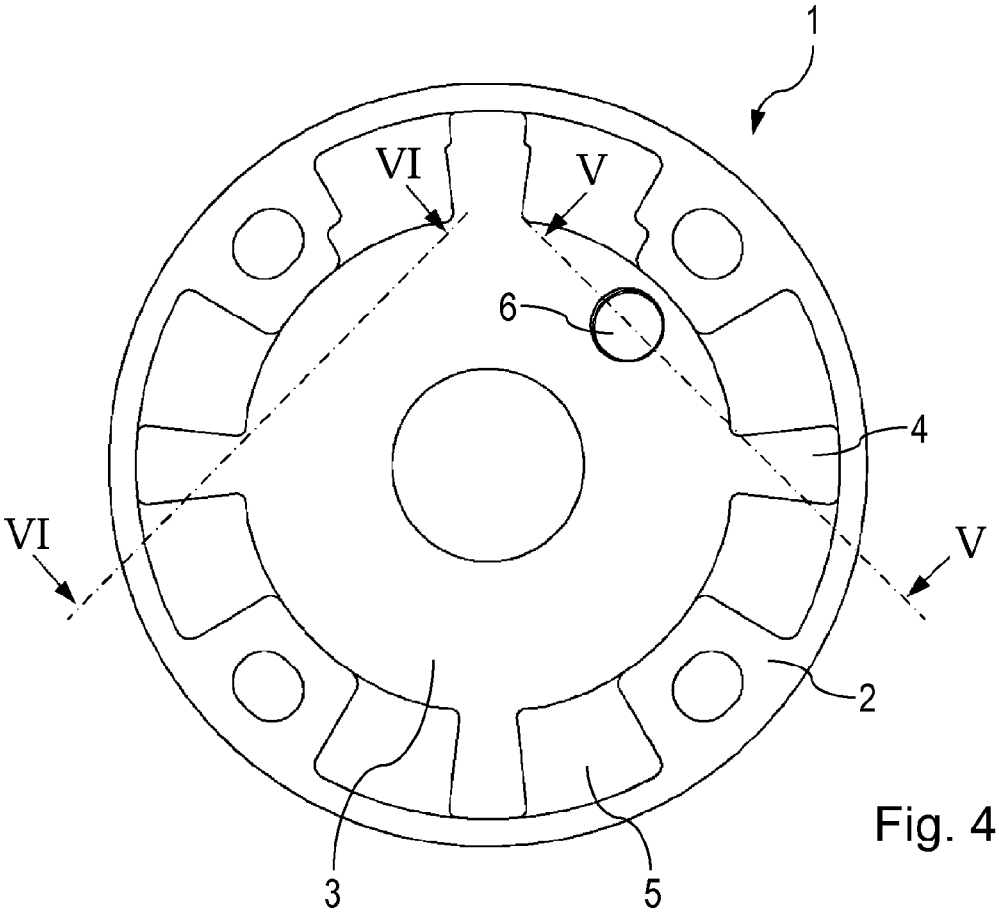
FIG. 4 shows a view from above, without a cover, of the hydraulic camshaft adjusting device from FIG. 1, including an additionally inserted spring element and a locking element situated thereupon in a recess of the rotor designed as a blind hole.
Figure 5:
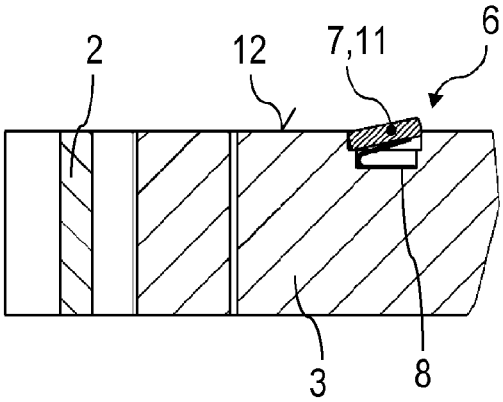
FIG. 5 shows a sectional view along line V of the components from FIG. 4.

With reference to FIGS. 4 and 5, let it be mentioned that camshaft adjusting device 1 also has a locking device 6, which includes at least one locking element 7 and a spring element 8 designed as a spring. (Spring element 8 is also referred to below as spring 8.) Locking element 7 and spring 8 are inserted into a recess 9 in rotor 3, which is designed as a blind hole. Spring 8 is designed separately from rotor 3, i.e., as a component which is separate from rotor 3.

In the embodiment illustrated, recess 9 is furthermore directly introduced/incorporated, for example drilled into, rotor 3. Alternatively, recess 9 may, however, also be introduced into a receiving bushing which is designed separately from rotor 3, this receiving bushing, in turn, being captively inserted, e.g., in a form-locked manner, into a hole in rotor 3 during operation.

In the embodiment illustrated, a spring element receiving section for accommodating spring element 8 is also present in recess 9, which is designed, in particular, for absorbing the pretensioning forces applied by spring element 8. In the specific embodiment which is the subject matter of the present invention, the spring element accommodating section is designed as a cuboid indentation 10 projecting into the rotor interior. Alternatively, spring 8 may, however, also be integrally connected to the section of rotor 3/recess 9 which forms the blind hole. For example, spring 8 may be designed as a resilient sheet metal strip which protrudes from the base/bottom of the blind hole, one end of spring 8 then being integrally designed with the bottom/base of recess 9.

Figure 2:
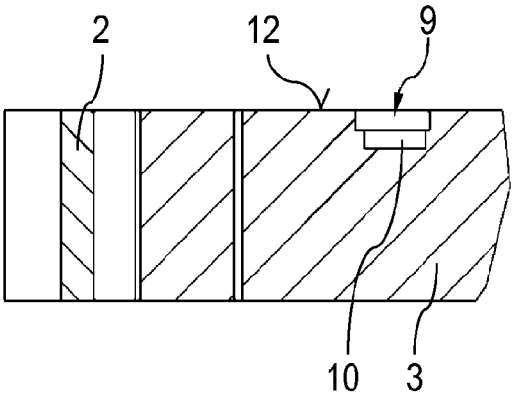
FIG. 2 shows a sectional view along line II of the components illustrated in FIG. 1.
Figure 3:
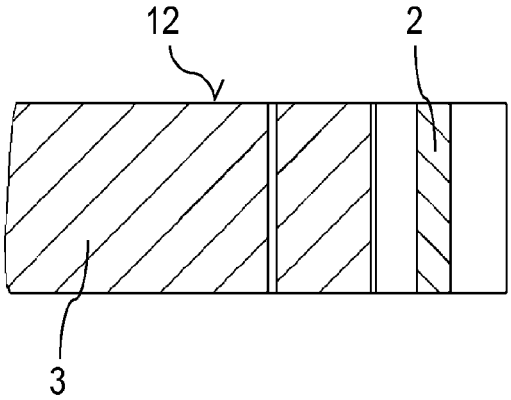
FIG. 3 shows a sectional view along line III of the components illustrated in FIG. 1.

The spatial extension of stator 2 and rotor 3 is apparent in the overall view in FIGS. 2 and 3.

Figure 6:
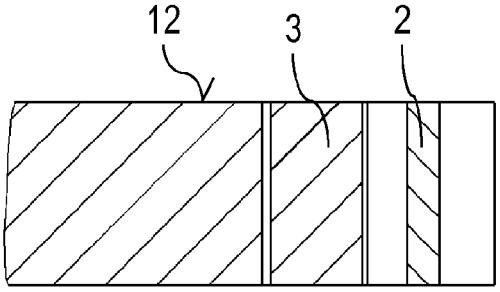
FIG. 6 shows a sectional view along line VI of the components from FIG. 4.

As is clear, in particular, in conjunction with FIGS. 4 through 6, locking element 7 is designed as a plate/plate-like spherical section 11, which is supported on rotor 3 via spring 8, spherical section 11 being insertable into the extension of indentation 10 facing away from the blind hole base, i.e., fitting into recess 9. When spherical section 11 is inserted all the way into recess 9, i.e., when it fully compresses spring 8, the planar surface of spherical section 11 facing away from the blind hole base is oriented flush with a front side 12 of rotor 3.

Figure 7:
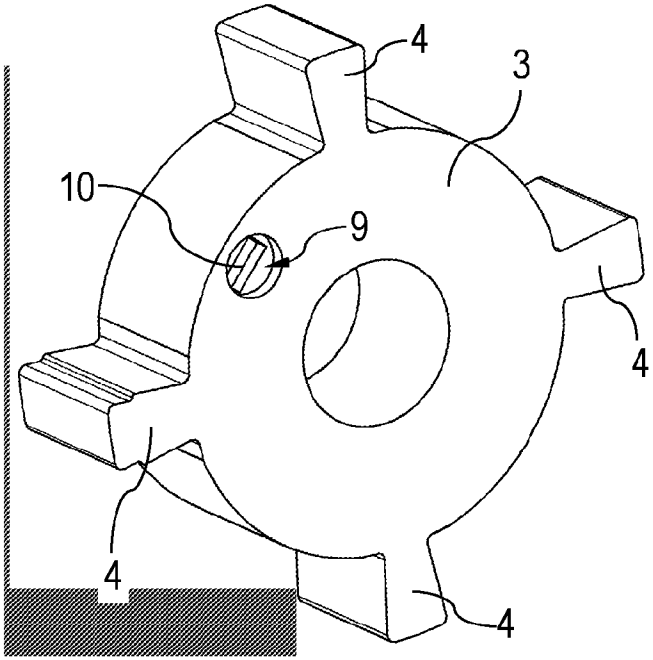
FIG. 7 shows a perspective representation of only the rotor in the exemplary embodiments in FIGS. 1 and 4.

The cross-shaped arrangement of vanes 4 on the outside of rotor 3 is indicated in FIG. 7.

A cover 13, which may be fastened to the stator, also has a recess 14, with which locking element 7, i.e., spherical section 11, is able to engage. Recess 14 is provided with a ramp-shaped base 15 of recess 14 of cover 13.

Figure 9:
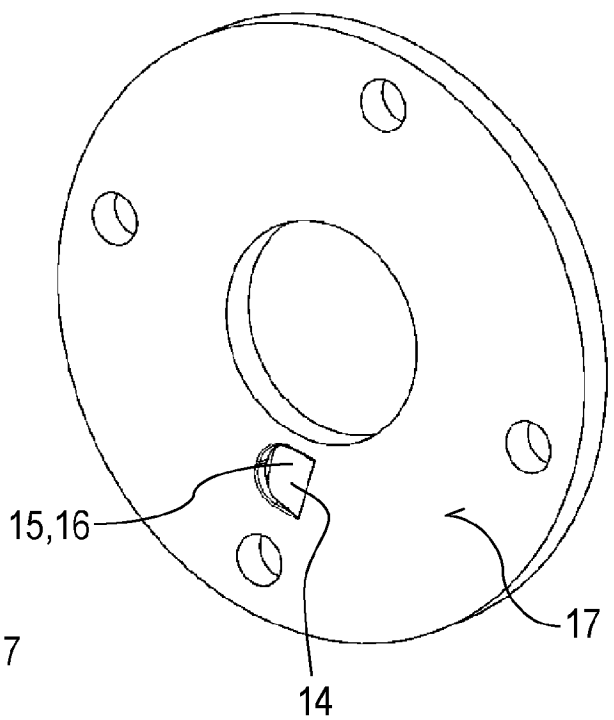
FIG. 9 shows a perspective representation of only the cover, viewed from the sides of the rotor.
Figure 8:
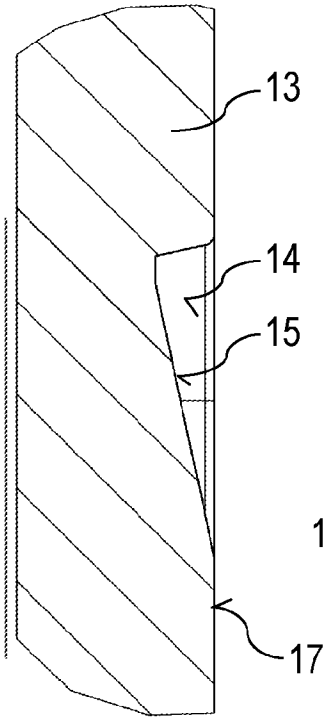
FIG. 8 shows an enlarged representation in a longitudinal sectional view of a cover which is connected to the rotor in the area of its front side, including a ramp-like recess provided therein for engaging with the locking element.

As is apparent in FIG. 9, in a top view, recess 14 has a kind of horseshoe-shaped or U-shaped outer contour, ramp/chamfer 16 formed by the base merging steplessly with a planar surface 17 of cover 13.

Figures 10, 11:
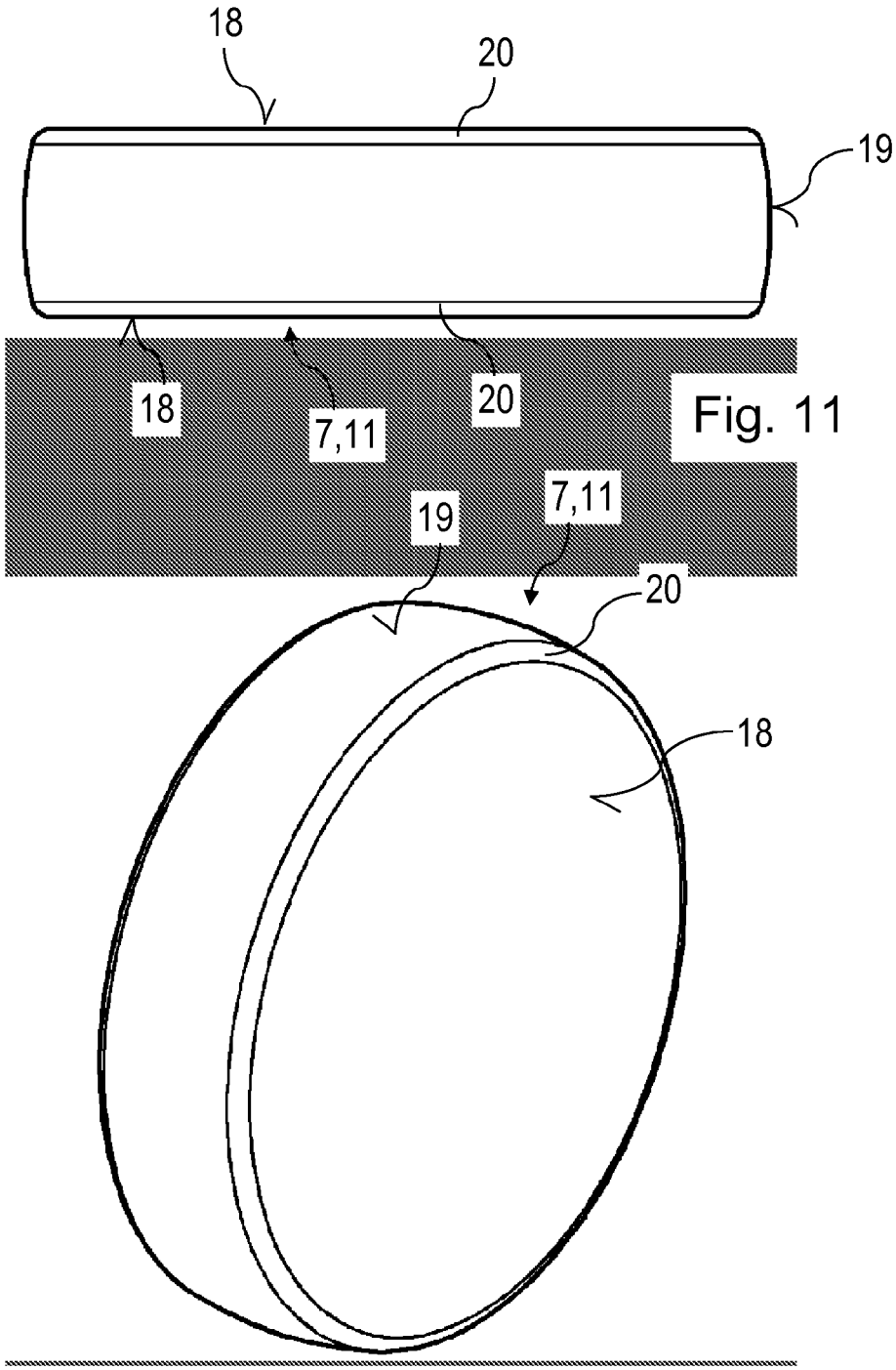
FIG. 10 shows a representation of only the locking element, which is designed as a spherical section.
FIG. 11 shows a side view of the locking element from FIG. 11.

A singular representation of locking element 7 is illustrated in FIGS. 10 and 11, which is designed in the manner of a spherical section 11. A convex outer contour 19 is present between two front surfaces 18 (of an arbitrary, preferably planar, design), which are the sides of a plate. The convex outer contour follows a spherical shape, a rounding or chamfer 20 being provided in the transition to front surfaces 18. Alternatively to the spherical shape, i.e., as a spherical rounding, the outer contour may, however, also have other shapes. The outer contour may thus also have any other elliptical/convex shape; however, it may also have a concave, smooth/planar/straight or a fluted design/course.

Figure 12:
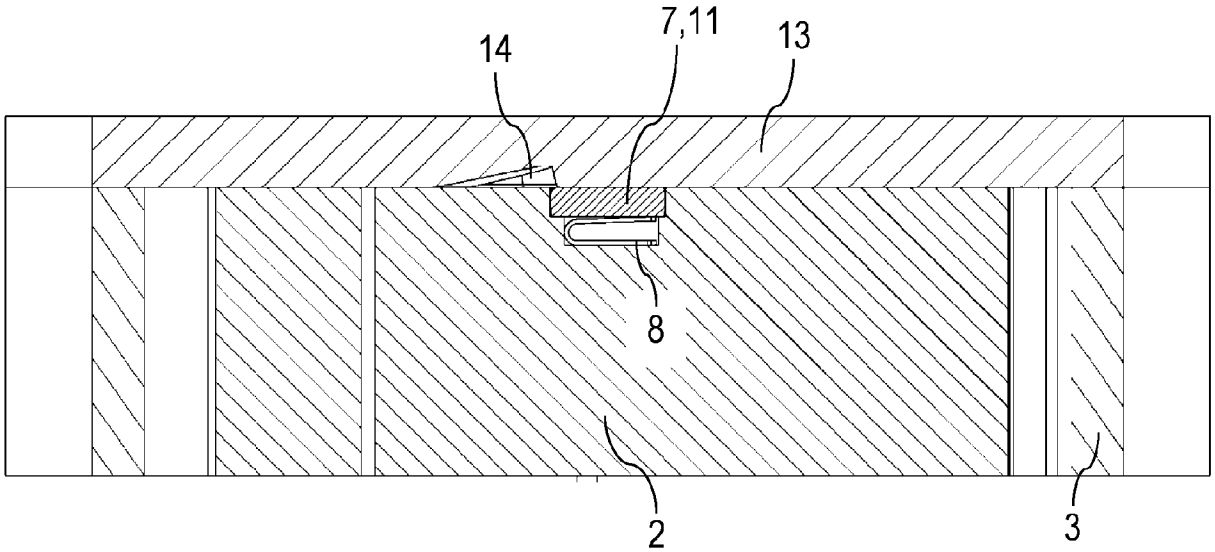
FIG. 12 shows the unlocked state in a sectional view of one section of the hydraulic camshaft adjusting device.
Figure 13:
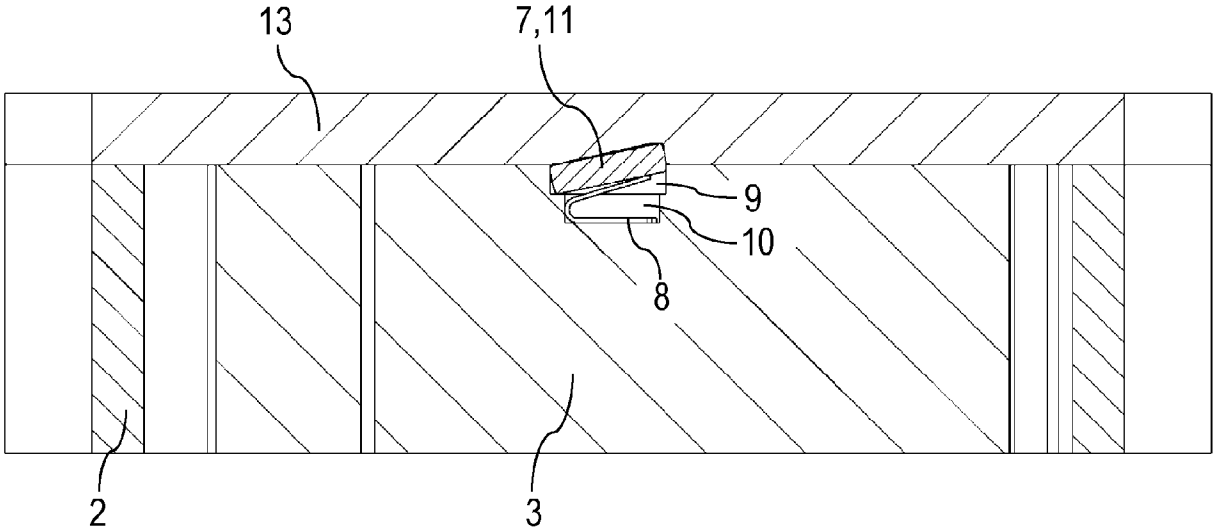
FIG. 13 shows the locked state of the hydraulic camshaft adjusting device in a type of representation comparable to FIG. 12.

The unlocked state and the locked state of rotor 3 on cover 13 are illustrated in FIGS. 12 and 13.

Another specific embodiment is illustrated in FIGS. 14 through 22, which uses two locking devices 6. In particular, FIGS. 17 through 19 and FIGS. 20 through 22 are informative in this case.

Figure 14:
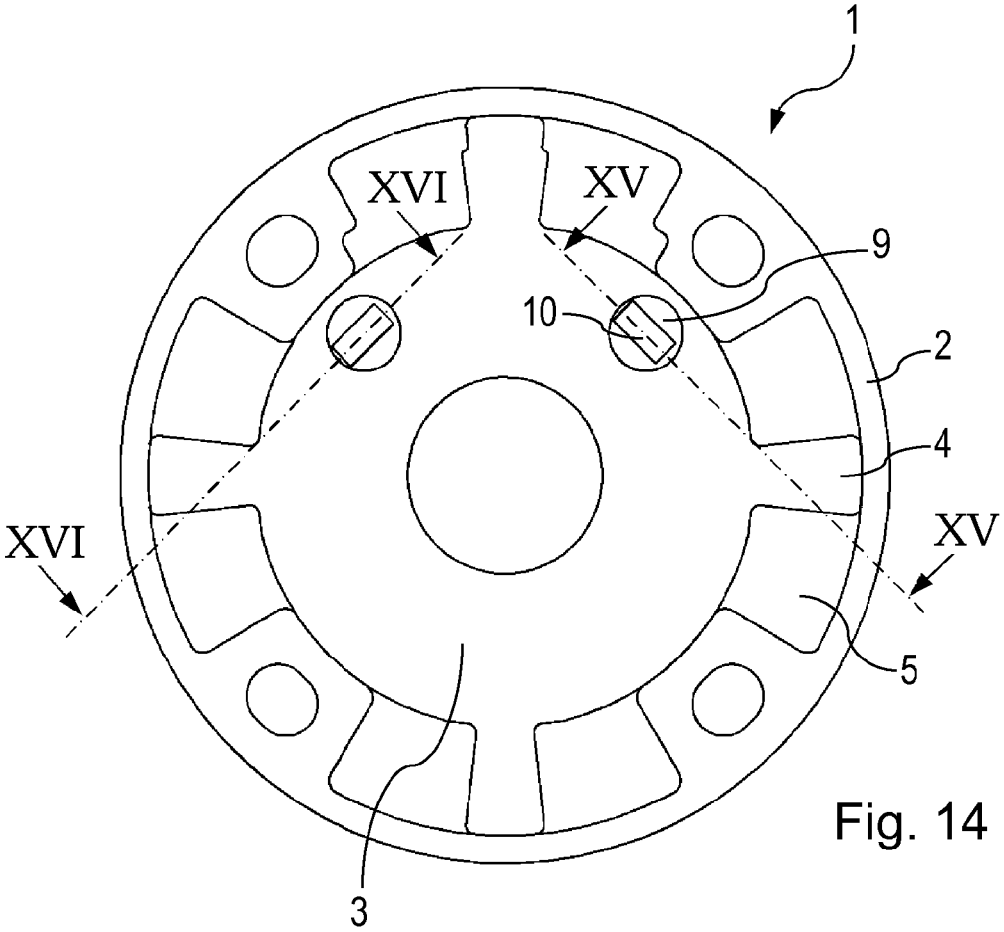
FIG. 14 shows a second specific embodiment of a hydraulic camshaft adjusting device in a manner comparable to FIG. 1, namely without a cover.
Figure 15:
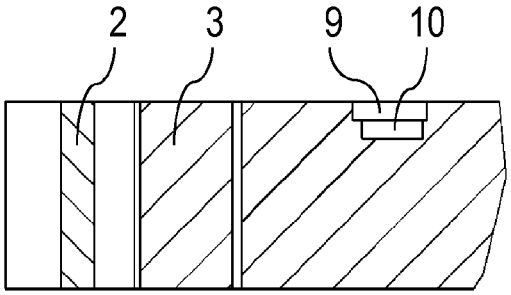
FIG. 15 shows a sectional view along line XV of the components from FIG. 14.
Figure 16:
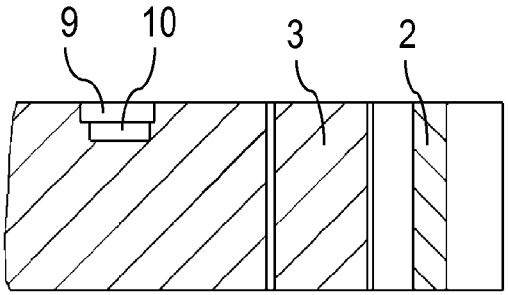
FIG. 16 shows a sectional view along line XVI of the components from FIG. 14.
Figure 17:
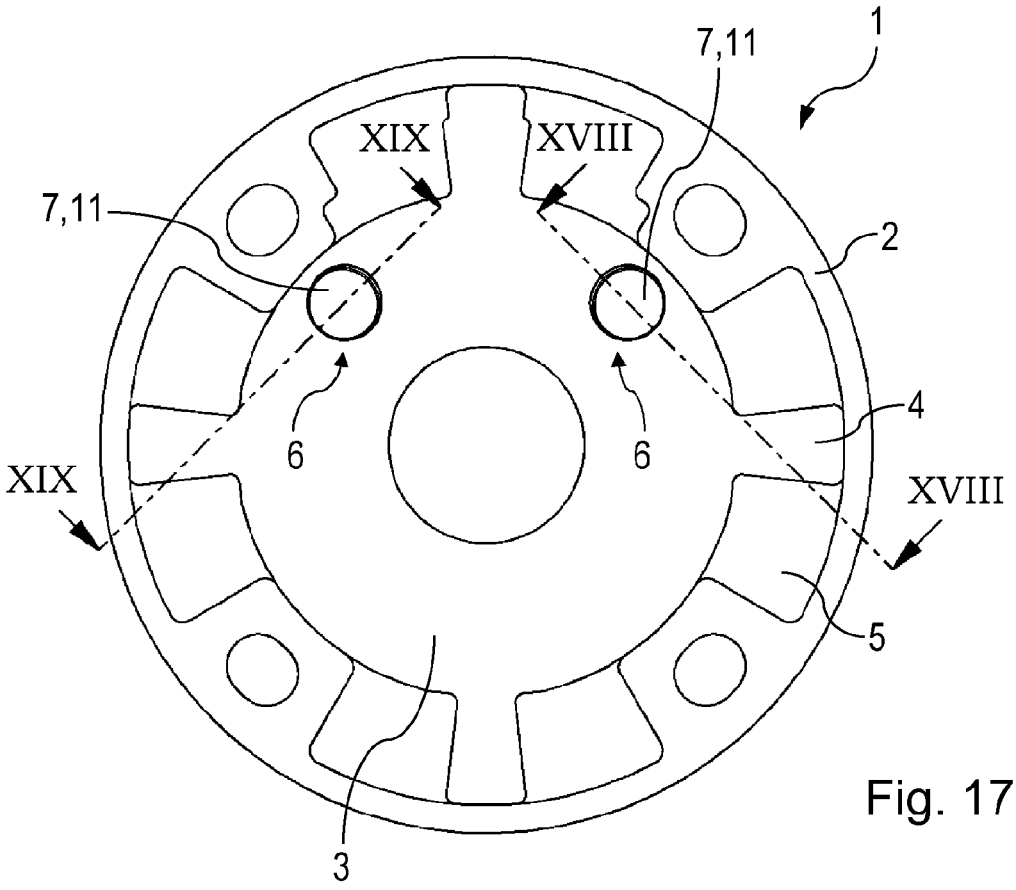
FIG. 17 shows the components from FIG. 14, but with inserted spring elements and locking elements.
Figure 18:
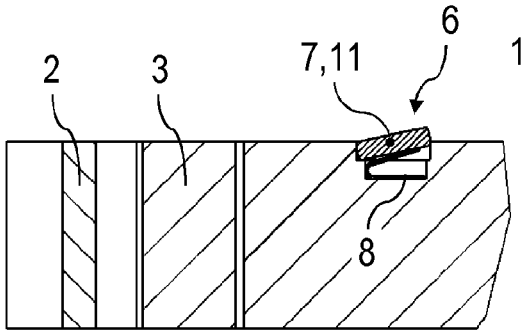
FIG. 18 shows a sectional view along line XVIII from FIG. 17.
Figure 19:
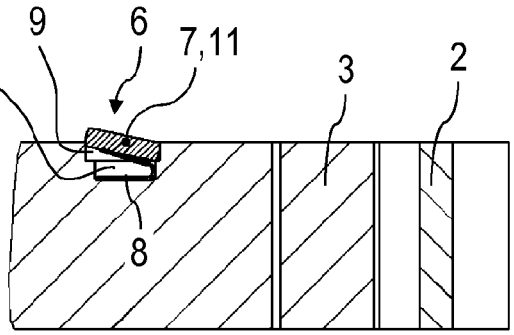
FIG. 19 shows a sectional view along line XIX of the components from FIG. 17.
Figure 20:
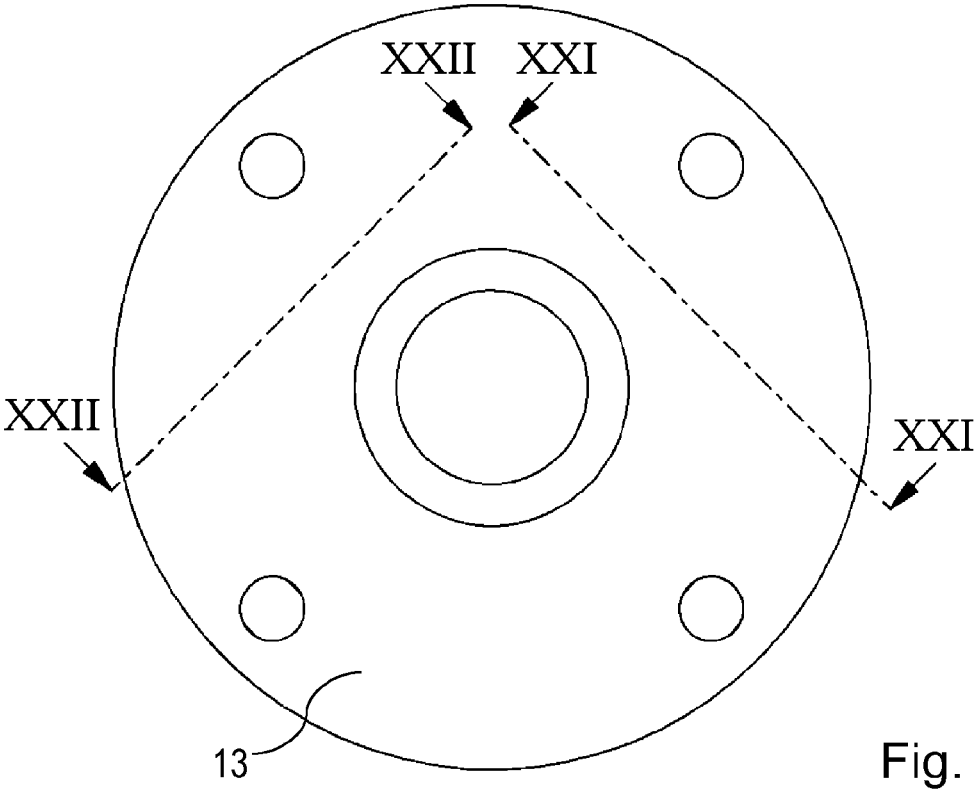
FIG. 20 shows a representation of a hydraulic camshaft adjuster provided with a cover, including two locking devices.
Figure 21:
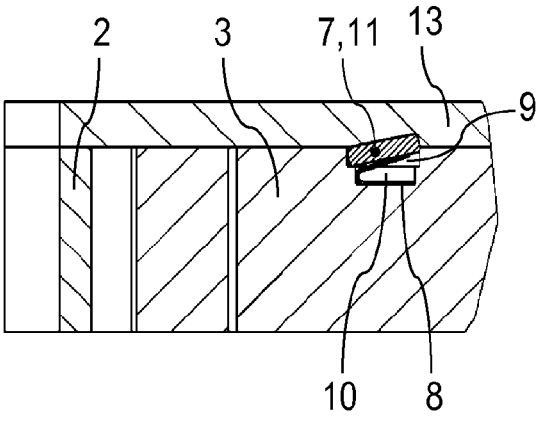
FIG. 21 shows a sectional view along line XXI of the components from FIG. 20.
Figure 22:
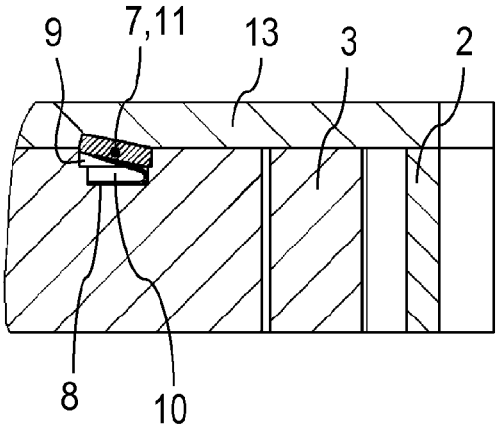
FIG. 22 shows a sectional view along line XXII from FIG. 20.

While the second specific embodiment is illustrated without a cover in FIGS. 14 through 16, this cover 13 is illustrated in FIGS. 20 through 22. Locking elements 7 are illustrated in FIGS. 17 through 19 (without a cover) and are not shown in the illustrations from FIGS. 14 through 16.

Figure 23:
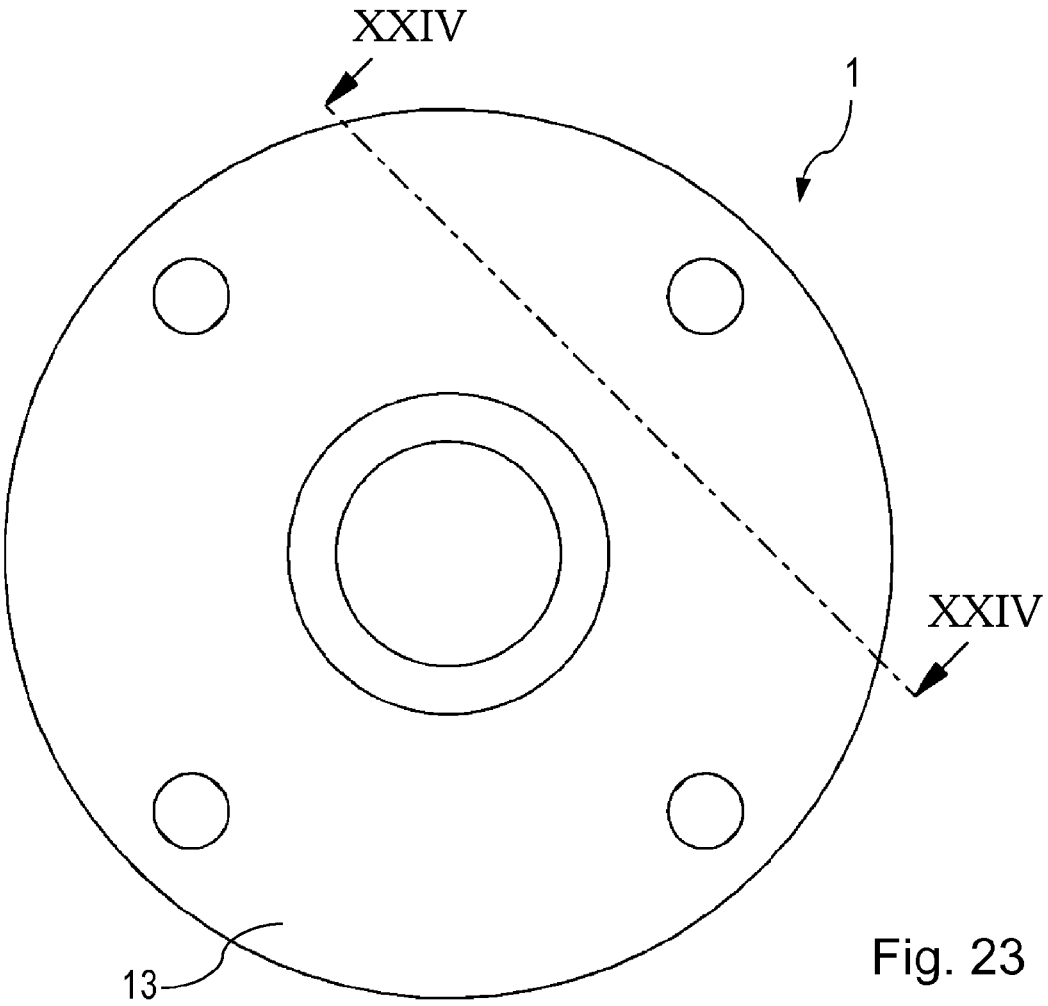
FIG. 23 shows a view from above of a third specific embodiment of a hydraulic camshaft adjusting device, including two locking devices which are situated on both front sides of the rotor.
Figure 24:
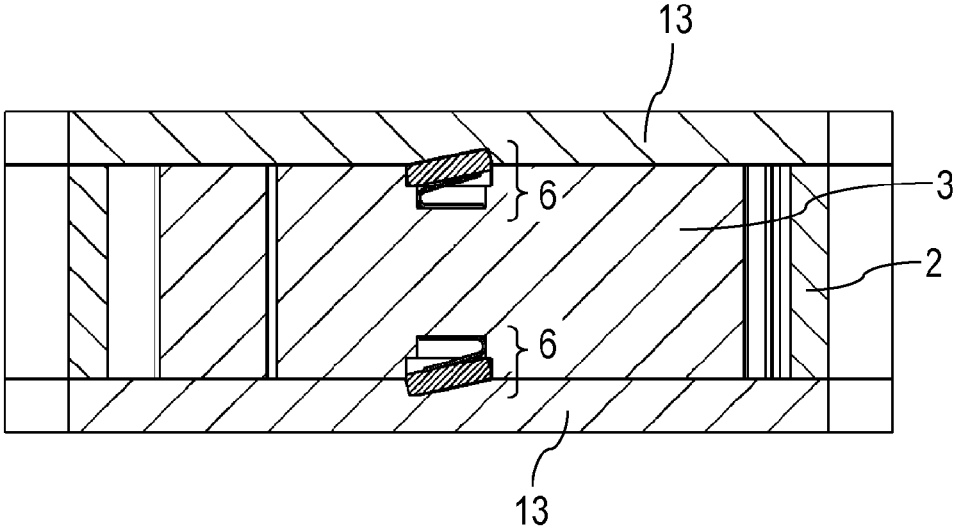
FIG. 24 shows a sectional view along line XIV of the components from FIG. 23.

In the exemplary embodiment illustrated in FIGS. 23 and 24, two locking devices 6 are installed and each engage with a cover 13, one cover 13 being situated on a front side of rotor 3, and the other cover being situated on the other front side.

LIST OF REFERENCE NUMERALS

1 camshaft adjusting device
2 stator
3 rotor
4 vane
5 vane cell
6 locking device
7 locking element
8 spring element/spring
9 recess
10 indentation
11 spherical section
12 front side
13 cover
14 recess in the cover
15 base of the recess in the cover
16 ramp/chamfer
17 planar surface
18 front surface of the spherical section
19 outer contour
20 rounding

What is claimed is:

1. A vane hydraulic camshaft adjusting device, comprising:

a stator;

a rotor situated concentrically as well as rotatably in the stator and having a front side; and a locking device being situated between the rotor and the stator for the purpose of preventing a rotation between the rotor and the stator in such a way that a locking element of the locking device produces a form-locked fit blocking the rotation, the locking element being a plate on the front side.

2. The camshaft adjusting device as recited in claim 1 wherein the plate has two sides connected to each other via an outer contour, the outer contour being provided with a concave, convex, smooth or fluted design.

3. The camshaft adjusting device as recited in claim 2 wherein the locking element has an ellipsoidal section or a spherical section.

4. The camshaft adjusting device as recited in claim 1 wherein the locking element is inserted into a blind hole by interposing a spring element, the blind hole being provided on the front side of the rotor.

5. The camshaft adjusting device as recited in claim 4 wherein the spring element is a sheet metal strip.

6. The camshaft adjusting device as recited in claim 4 wherein the blind hole accommodating the spring element is introduced into the rotor or into a receiving bushing, the receiving bushing being separate from the rotor and connected to the rotor in an operating state.

7. The camshaft adjusting device as recited in claim 4 wherein the blind hole has a spring element receiving section on a base, the spring element being at least partially supported in the spring element receiving section.

8. The camshaft adjusting device as recited in claim 7 wherein the spring element receiving base is an indentation.

9. The camshaft adjusting device as recited in claim 1 wherein the locking element engages with a recess on a stator-fixed component in a rotation-inhibiting manner, or engages with a recess in the front side of the rotor in a rotation-inhibiting manner.

10. The camshaft adjusting device as recited in claim 9 wherein the stator-fixed component is a cover.

11. The camshaft adjusting device as recited in claim 10 further comprising a further locking element for implementing a center-locking mechanism with the locking element.

12. The camshaft adjusting device as recited in claim 11 wherein the locking element and a spring element are each situated in a hole in such a way that the spring element axially moves at least one part of the locking element assigned thereto in such a way that a rotation of the rotor is prevented in both rotational directions.

13. The camshaft adjusting device as recited in claim 9, wherein the spring element is configured for urging the plate from a position inside the rotor into a position at least partially outside the rotor and into the recess of the stator-fixed component to block the rotation between the rotor and the stator.

14. The camshaft adjusting device as recited in claim 13, wherein the plate has a first side and a second side connected via an outer contour, the locking device being configured such that a part of the outer contour remaining inside the rotor and another part of the outer contour protruding into the recess of the stator-fixed component to block the rotation between the rotor and the stator.

15. The camshaft adjusting device as recited in claim 1 further comprising a second locking device present on the front side of the rotor or on the other front side of the rotor.

16. The camshaft adjusting device as recited in claim 1, wherein the plate has a first side and a second side connected via an outer contour, the locking device being configured such that the first side is at least partially within the rotor and the second side is at least partially outside the rotor when the locking element blocks the rotation between the rotor and the stator.

17. The camshaft adjusting device as recited in claim 16, wherein the locking device is configured such that the outer contour is partially inside the rotor and partially outside of the rotor when the locking element blocks the rotation between the rotor and the stator.

18. The camshaft adjusting device as recited in claim 1, wherein the locking device is configured such that the plate protrudes past the front side when the plate blocks the rotation between the rotor and the stator.

* * * * *